US006152106A

United States Patent [19]

Reese, II et al.

[11] Patent Number: 6,152,106

[45] Date of Patent: Nov. 28, 2000

[54] POWER STEERING LOAD COMPENSATION FOR AN INTERNAL COMBUSTION ENGINE

[75] Inventors: Ronald A. Reese, II, Goodrich; Ken Hardman, Royal Oak, both of Mich.

[73] Assignee: DaimlerChrysler Corporation, Auburn Hills, Mich.

[21] Appl. No.: 09/288,839

[22] Filed: Apr. 8, 1999

[51] Int. Cl.[7] ..... F02D 41/08

[52] U.S. Cl. ..... 123/339.16; 180/69.3

[58] Field of Search ..... 123/339.16; 180/69.3, 180/417

[56] References Cited

U.S. PATENT DOCUMENTS

| | | | |
|---|---|---|---|
| 3,600,965 | 8/1971 | Folkerts et al. | 74/339 |
| 3,791,147 | 2/1974 | Nuss | 60/422 |
| 4,545,449 | 10/1985 | Fujiwara | 123/339.16 |
| 4,724,810 | 2/1988 | Poirier et al. | 123/339.16 |
| 5,097,808 | 3/1992 | Tanaka et al. | 123/339.16 |
| 5,531,287 | 7/1996 | Sherman | 180/417 |
| 5,641,033 | 6/1997 | Langkamp | 180/422 |
| 5,947,084 | 9/1999 | Russell et al. | 123/339.16 |

FOREIGN PATENT DOCUMENTS

| | | | |
|---|---|---|---|
| 1-93040 | 8/1989 | Japan | 123/339.16 |
| 1-32852 | 5/1992 | Japan | 123/339.16 |
| 1-18234 | 5/1993 | Japan | 123/339.16 |
| 1-73738 | 6/1994 | Japan | 123/339.16 |

*Primary Examiner*—Willis R. Wolfe
*Attorney, Agent, or Firm*—Mark P. Calcaterra

[57] ABSTRACT

A power steering load compensation system for an internal combustion engine which employs a pressure sensor to monitor the output pressure of the power steering pump. The pressure sensor provides an input signal to an engine controller, and the engine controller generates an automatic idle speed output signal for controlling the idle speed motor of the engine throttle body. By varying the air flow through the throttle body in accordance with output pressure of the power steering pump, which varies with the pump load placed upon the engine, dips and surges in engine revolutions per minute (RPM) at idle and low speeds may be substantially reduced.

7 Claims, 2 Drawing Sheets

| PUMP OUTLET PRESSURE (PSI) | ENGINE SPEED (RPM) 500 | 600 | 750 | 900 | 1200 | |
|---|---|---|---|---|---|---|
| 100 | 0.11 | 0.21 | 0.28 | 0.33 | 0.46 | PUMP POWER |
| 500 | 0.47 | 0.61 | 0.78 | 0.94 | 1.28 | |
| 900 | 0.81 | 1.05 | 1.33 | 1.57 | 2.08 | |
| 1100 | 0.98 | 1.24 | 1.56 | 1.89 | 2.52 | |
| 1300 | 1.16 | 1.44 | 1.82 | 2.14 | 2.85 | |
Fig-3
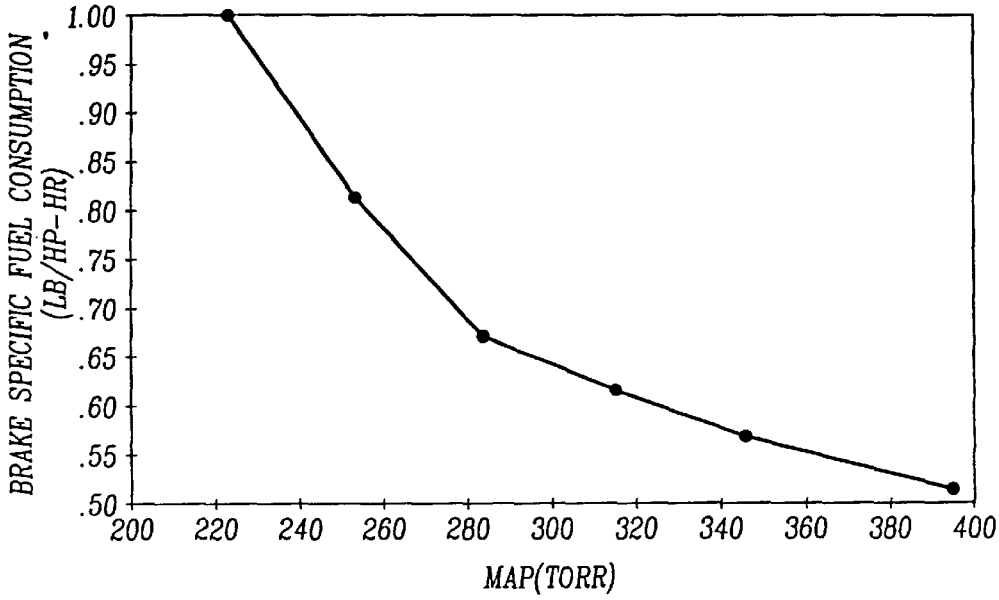
Fig-4
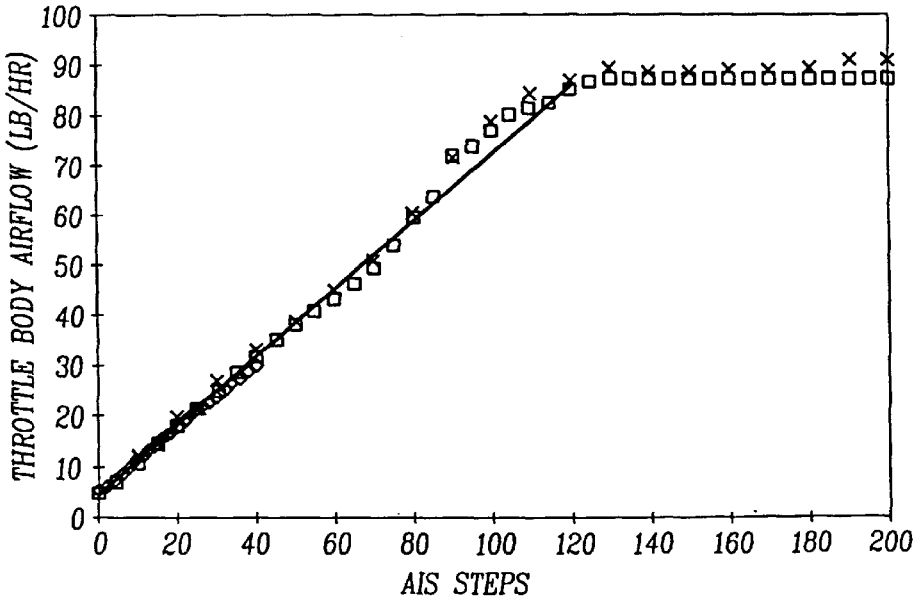
Fig-5

POWER STEERING LOAD COMPENSATION FOR AN INTERNAL COMBUSTION ENGINE

BACKGROUND OF THE INVENTION

1. Field of the Invention

This invention relates generally to power steering load compensation systems and, more particularly, to an apparatus which uses a power steering pressure sensor to monitor the output of a power steering pump in order to provide pressure information to an engine controller so that the idle speed of the engine may be adjusted in accordance with the output of the power steering pump, thereby minimizing variations in idle speed based upon operation of the power steering system.

2. Description of the Related Art

The use of hydraulically assisted power steering in medium and larger sized automobiles has become generally standard throughout the automotive industry. Most vehicle operators enjoy the ease of use which a power steering system provides. In operation, power steering systems typically use a power rack-and-pinion system or an integral power steering gear assembly. Rack-and-pinion systems are typically installed on front wheel drive cars, while integral power steering gear systems are used on rear-wheel drive vehicles.

In a typical power steering system, the engine drives the power steering pump through a belt and pulley arrangement. The power steering pump includes a pressure hose and a return line, and typically also includes a control valve to modulate fluid pressure within the hydraulic circuit. The power steering pump generates fluid pressure. When the operator turns the steering wheel, the fluid pressure is directed to mechanically assist displacement of the steering assembly.

Although present power steering systems provide suitable assistance to facilitate the steering operation of the vehicle, at idle and low speeds, existing power steering systems exert a load on the engine which causes the idle speed to fluctuate in accordance with the load applied by the power steering pump. More specifically, with the vehicle at idle speed and the wheels generally centered, the power steering pump places minimal load on the engine, as no power steering pump assistance is required. When the operator displaces the steering wheel to the left or the right, hydraulic fluid pressure is used to displace the steered wheels. In order to provide sufficient hydraulic fluid pressure, the power steering pump places a load on the engine which causes the idle speed revolutions per minute (RPM) to decrease or dip. Conversely, when the operator displaces the steering wheel to center the steered wheels, the power steering pump again places a load on the engine that causes the idle speed to drop. When the steered wheels are returned to the center position and the pressure output by the power steering pump drops, the power steering pump load on the engine decreases. A decrease in the power steering pump load consequently causes the engine idle speed to increase or surge. In addition to dips and surges, particularly during maneuvers in a parking lot, variations in the power steering pump load placed on the engine can cause vibrations due to vehicle body resonance when engine idle speed drops below the target idle speed.

Thus, it is an object of the present invention to provide power steering load compensation for an internal combustion engine.

It is a further object of the present invention to reduce engine speed variation resulting from variations in the power steering pump load as a steering wheel is moved, particularly at idle and low speeds.

It is yet a further object of the present invention to reduce vehicle body vibrations by maintaining a substantially constant idle speed regardless of power steering pump load.

It is yet a further object of the present invention to improve overall vehicle responsiveness while executing steering maneuvers at idle and low speeds.

SUMMARY

This invention is directed to an engine control system for compensating for a load placed on the engine by a steering system for displacing steerable wheels of the vehicle. A steering apparatus variably displaces the wheels of the vehicle in accordance with an input supplied to the steering apparatus, such as by the vehicle operator. A steering assist device provides mechanical advantage to the input to facilitate displacement of the wheels by the steering apparatus, wherein operation of the steering assist device exerts a load on the engine which varies at least partially in accordance with the mechanical advantage provided by the steering assist device. A sensor generates an output signal that varies at least partially in accordance with the mechanical advantage provided by the steering assist device. An engine controller for varying the power output by the engine, wherein the engine controller varies the power output by the engine in accordance with the output signal provided by the sensor.

Additional objects, features, and advantages of the present invention will become apparent in the following description and the appended claims taken in connection with the accompanying drawings.

BRIEF DESCRIPTION OF THE DRAWINGS

FIG. 3 is an exemplary lookup table for determining the power required to drive the power steering pump in accordance with engine speed and pump outlet pressure;

FIG. 4 is an exemplary graph showing the relationship between manifold absolute pressure and brake specific fuel consumption; and FIG. 5 is a graph showing the relationship between automatic idle speed steps and throttle body air flow.

DETAILED DESCRIPTION OF THE INVENTION

Figure 1:
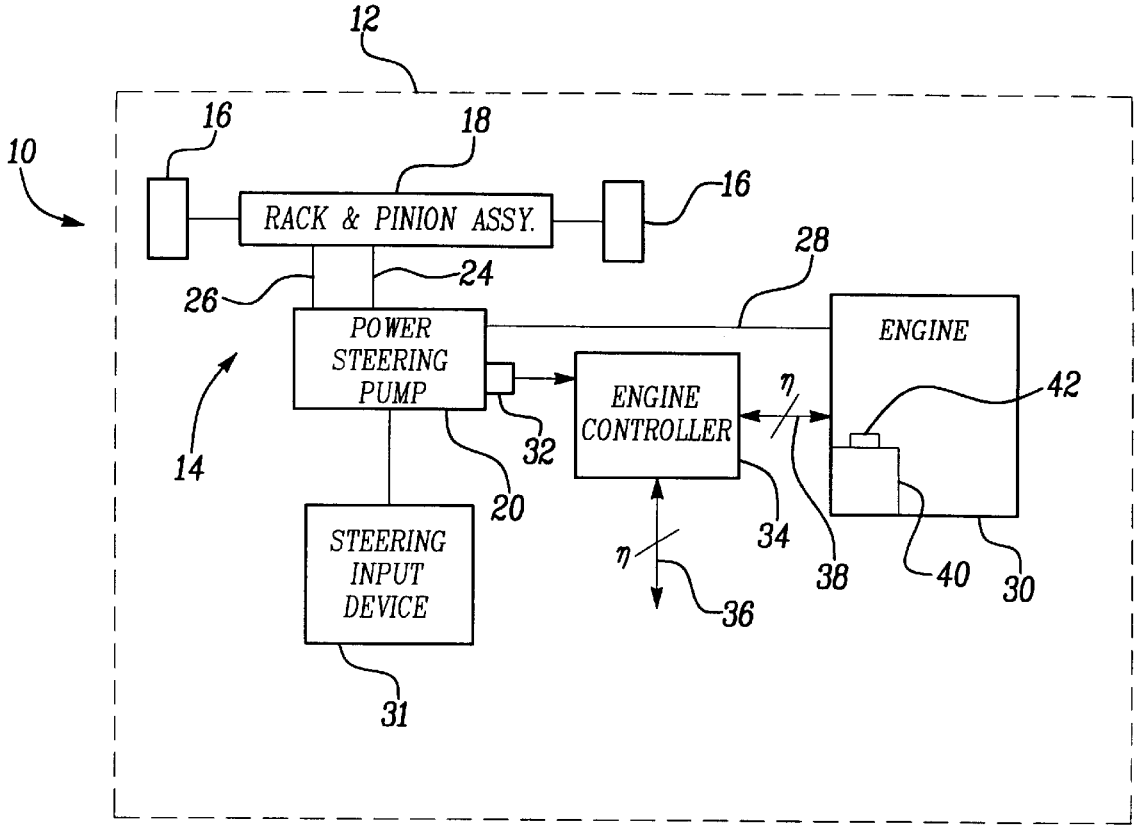
FIG. 1 is a block diagram of the power steering load compensation system for an internal combustion engine system arranged in accordance with principles of the present invention.

With reference to FIG. 1, the power steering compensation system 10 for a load placed on the engine at idle and low speeds by a power steering system 14 is shown. The control system 10 is implemented on a vehicle 12. Vehicle 12 includes a power steering system 14 for steerably displacing a pair of steered wheels 16. Steered wheels 16 are arranged as part of a rack-and-pinion steering gear assembly 18, for causing displacement of steered wheels 16. Integral with rack-and-pinion steering gear assembly 18 is a power steering pump 20 which provides hydraulic fluid pressure that provides mechanical advantage to rack-and-pinion steering gear assembly 18 to facilitate displacement of steered wheels 16.

Power steering pump 20 provides fluid pressure to rack-and-pinion gear assembly 18 through a pressure hose 24, and fluid circulating through rack-and-pinion gear assembly 18 returns to power steering pump 20 through bypass hose 26. Mechanical input to power steering pump 20 is provided through a belt and pulley arrangement 28. Engine 30 provides the driving force for operating power steering pump 20 through belt and pulley assembly 28. Steering inputs to power steering pump 20 and rack-and-pinion gear assembly 18 are provided by an operator-controlled steering input device 31, such as a steering wheel or other steering mechanism.

Fluid circulating through power steering pump 20 circulates at a pressure through pressure hose 24. A power steering pressure sensor 32 generates a voltage signal which varies in accordance with the fluid pressure output by power steering pump 20. The variable voltage signal output by pressure sensor 32 is input to engine controller 34. Engine controller 34 receives additional inputs on signal lines 36 and on signal lines 38. Such signal inputs include various engine, transmission, and related powertrain parameters for determining optimum operation of engine 30 and, optionally, other power train components. Engine controller 34 also generates output signals to control engine 30 and, optionally, other powertrain components. More particularly, engine controller 34 sends and receives signals to engine 30 on signal lines 38. Engine 30 includes a throttle body 40 having an orifice the size of which may be controlled by a stepper motor 42, thereby varying air intake to engine 30.

In operation, when the vehicle operator applies a steering input through steering input device 31, power steering pump 20 generates a control pressure in pressure hose 24 to assist displacement of rack-and-pinion gear assembly 18, thereby controlling steered wheels 16. Because power steering pump 20 is driven by engine 30 through belt and pulley assembly 28, an increase in the pressure output by power steering pump 20 typically requires increasing the load on engine 30 through belt and pulley assembly 28 to drive power steering pump 20.

At medium and high vehicle speeds, engine 30 outputs ample load to sufficiently drive power steering pump 20 to provide all required fluid pressure. However, at idle and low speeds, because engine output is generally low, variations in fluid pressure output by power steering pump 20 can cause corresponding variations in the idle or low speeds of engine 30 due to load placed on engine 30 by power steering pump 20. As discussed above, a turning maneuver may cause a drop in engine revolutions per minute (RPM), and completion of a steering operation may cause a surge in engine RPM. In operation, the present invention uses pressure sensor 32 to sense variations in hydraulic fluid pressure. Pressure sensor 32 outputs a voltage signal to engine controller 34 which correspondingly generates a control signal to minimize RPM dips or surges to substantially maintain the idle or low speed of engine 30. More particularly, engine controller 34 generates a separate motor control signal input to stepper motor 42 in order to vary the air intake through throttle body 40 into the intake manifold.

In order to control stepper motor 42, engine controller 34 generates an automatic idle speed (AIS) signal which correlates to stepwise displacement of stepper motor 42, as is known to those skilled in the art. Idle speed motor 42 controls air intake into the engine by varying the orifice through which intake air may pass. More particularly, the AIS steps are determined in accordance with the following equation.

$$AIS\ \text{Steps} = \left[\frac{\text{Pump Power} \times BSFC \times 14.7}{AIS\ \text{Flow Characteristic}}\right]\left[\frac{AIS\ \text{Flow Calibration Pressure}}{BARO}\right] \quad (1)$$

Each of the terms for equation 1 will be explained herein.

More specifically, the first term determines the airflow required, in steps, for the pump load compensation. Each element of the first term will be described herein in detail.

1. Pump Power

Pump power is the load required to drive power steering pump 20 and is a function of the power steering pump outlet pressure and pump speed. Pump speed is related to engine speed or RPM by a constant, which is the pulley ratio of belt and pulley assembly 28. Outlet pressure is determined by pressure sensor 32, which outputs a voltage signal to engine controller 34. An example of a pressure sensor 32 is manufactured by Kavlico as part number P604-9292, rev G.

Figure 2:
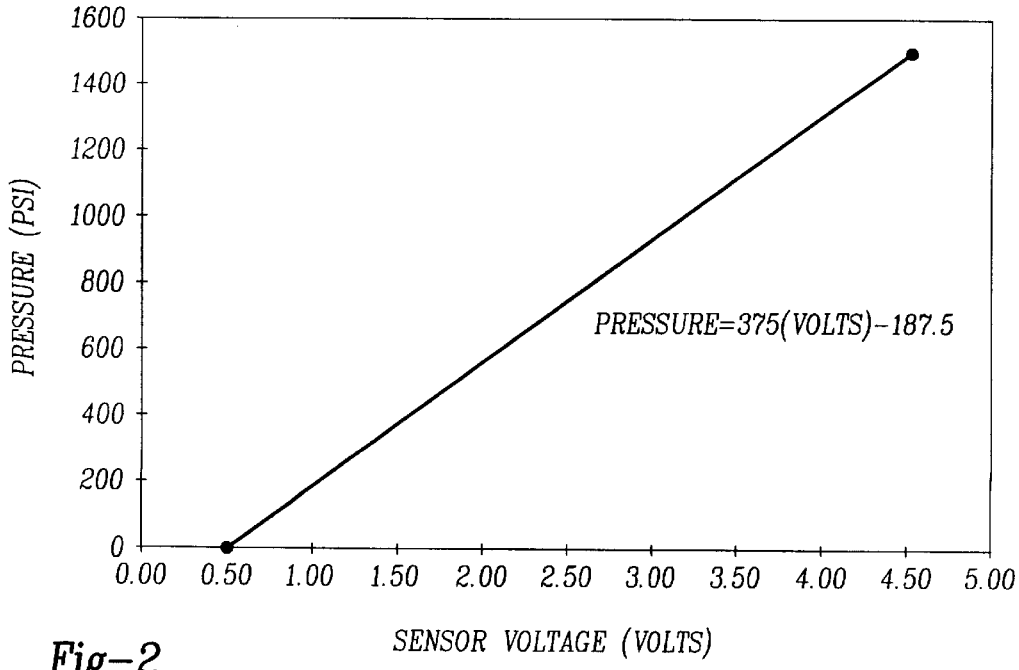
FIG. 2 is a graph showing the relationship between sensor voltage and power steering fluid pressure.

FIG. 2 is a graph showing the measured pressure as a function of output voltage of pressure sensor 32 and is exemplary of a pressure sensor which may be used in the present system. The relationship shown in FIG. 2 may be stored in memory as a lookup table or defined by an equation for use by engine controller 34. After the pump outlet pressure and engine RPM have been determined, pump power may be determined from a lookup table. FIG. 3 is an exemplary lookup table which may be stored in memory for use by engine controller 34. Power steering pump 20 described herein may be implemented as Chrysler part No. 4695653, which is a constant displacement pump of 8.4 cubic centimeters per revolution with an internal bypass to maintain a six liter per minute flow to rack-and-pinion assembly 18. As can be seen with reference to FIG. 3, pump power increases linearly with increasing engine speed or power steering pump outlet pressure.

2. BSFC (Brake Specific Fuel Consumption)

BSFC is a term which enables conversion of the pump power to engine fuel flow. If engine 30 is operating at stoichiometric, the air/fuel ratio enables complete combustion. As is known to those skilled in the art, 14.7 lbs. of air to 1 lb. of fuel (gasoline) provides stoichiometric operation. Assuming engine 30 is operating at stoichiometric, BSFC is multiplied by 14.7 to convert fuel flow to air flow. BSFC is predetermined and is stored in engine controller 34 as an equation or in a lookup table in memory. The lookup table is generated in accordance with the graph shown in FIG. 4. As can be seen with respect to FIG. 4, BSFC is a function of the manifold absolute pressure (MAP), which is measured in torr.

3. AIS Flow Characteristic

AIS flow characteristic is a linearlized relationship between air flow and AIS steps to control the idle speed motor for the throttle body 40. FIG. 5 depicts exemplary data for three different flow tests of one model of throttle body. From FIG. 5, one can show that the slope of the line for AIS steps between 0 and 120 is 0.68, which is characteristic for the model of throttle body tested. An equation describing the graph of FIG. 5 or a lookup table representing this graph is stored in memory in engine controller 34.

The relationship shown in FIG. 5 is valid so long as AIS flow is choked, and therefore, AIS flow is independent of downstream pressure. One skilled in the art will recognize that choked flow occurs when a 50% pressure ratio appears across an orifice. Under typical engine idling conditions, MAP is less than 50% of the barometric pressure (BARO), so AIS flow is choked, and the relationship of FIG. 5 is valid.

The second term of Equation (1) is an altitude compensation term which corrects the calculated AIS steps determined in the first term for proper operation at various altitudes.

1. AIS Flow Calibration Pressure

AIS flow calibration pressure is the ambient pressure at which the AIS flow characteristic of the first term was determined. The AIS flow characteristic is typically corrected to standard pressure and temperature (STP) so that the AIS flow calibration pressure is typically 760 torr.

2. BARO (barometric pressure)

The barometric pressure is determined by the MAP sensor before the engine is started and stored in memory engine controller 34.

Referring to the second term, since AIS flow is choked at idle, volume air flow is only a function of AIS steps; however, mass air flow is also a function of upstream air density. Applying an ideal gas law assumption, the pressure effects are taken into account as a ratio between the ambient pressure at which the AIS characteristic was determined and the barometric pressure.

In operation, the above-described power steering load compensation system is implemented so that the AIS steps are determined in the background loop processing period of engine controller 34. Further, Equation 1 determines an absolute number of steps required for load compensation. A differential number of steps from the previous loop period, however, must be determined. Thus, the absolute number of steps is stored in the previous loop so that the difference between the present number of AIS steps and the previous number of AIS steps may be determined as a delta and applied to the AIS output value. Further, in operation, it has been determined that improved results may be obtained by reducing the BSFC output by 35% and by maintaining constant pump power above 1,100 PSI in the pump power lookup table of FIG. 3.

Although the invention has been described with particular reference with certain embodiments thereof, variations and modifications can be effected within the spirit and scope of the following claims. In particular, one skilled in the art will recognize that the above described system may be implemented in any power steering system in which a power steering pump places a load on the engine.

What is claimed is:

1. An engine control system for compensating for a load placed on the engine by a steering system for displacing steerable wheels of the vehicle, comprising:

a steering apparatus for variably displacing the wheels of the vehicle in accordance with an input supplied to the steering apparatus;

a steering assist device for providing mechanical advantage to the input to facilitate displacement of the wheels by the steering apparatus, wherein operation of the steering assist device exerts a load on the engine which varies at least partially in accordance with the mechanical advantage provided by the steering assist device;

a sensor for generating a variable output signal that varies at least partially in accordance with the mechanical advantage provided by the steering assist device;

an engine controller for varying the power output by the engine, wherein the engine controller varies the power output by the engine in accordance with the output signal provided by the sensor;

wherein the engine controller generates a signal to operate the stepper motor to a displacement in steps in accordance with the following relation:

$$\text{No. Steps} = \left[\frac{\text{pump power} \times BSFC \times 14.7}{\text{flow characteristic}}\right] \times \left[\frac{\text{flow calibration pressure}}{BARO}\right], \text{ where}$$

pump power is the load required to drive the steering assist device,

BSFC is a brake specific fuel consumption, flow characteristic is a relationship between air flow and the number of steps, flow calibration pressure is an ambient pressure at which the flow characteristic is determined, and BARC is the barometric pressure.

2. The apparatus of claim 1 wherein the engine controller generates a signal to vary an intake airflow into the engine.

3. The apparatus of claim 2 wherein the steering assist device is a hydraulic pump which generates a hydraulic fluid pressure to provide mechanical advantage to the input to facilitate displacement of the wheels.

4. The apparatus of claim 3 wherein the engine control system compensates for load placed on the engine by the steering system when the engine is at an idle speed.

5. The apparatus of claim 2 wherein the engine control system compensates for load placed on the engine by the steering system when the engine operates generally at idle revolutions per minute (RPM).

6. The apparatus of claim 2 wherein the sensor is a hydraulic pressure sensor which outputs a variable voltage signal that varies in accordance with the hydraulic pressure output by the hydraulic pump.

7. The apparatus of claim 1 wherein the engine controller varies the power output by the engine in accordance with the output signal generated by the pressure sensor.

* * * * *